US007244537B2

(12) United States Patent
Ohwada

(10) Patent No.: US 7,244,537 B2
(45) Date of Patent: Jul. 17, 2007

(54) TONER FOR DEVELOPING AN ELECTROSTATIC CHARGE IMAGE AND METHOD FOR ITS PRODUCTION

(75) Inventor: Takeshi Ohwada, Joetsu (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 11/221,758

(22) Filed: Sep. 9, 2005

(65) Prior Publication Data

US 2006/0003245 A1 Jan. 5, 2006

Related U.S. Application Data

(63) Continuation of application No. PCT/JP03/013196, filed on Oct. 15, 2003.

(30) Foreign Application Priority Data

Oct. 15, 2003 (JP) ..... 2003-063899

(51) Int. Cl.
*G03G 9/00* (2006.01)

(52) U.S. Cl. ..... 430/108.3; 430/108.1; 430/109.5; 430/110.1; 430/111.4

(58) Field of Classification Search ..... 430/108.3, 430/108.1, 109.5, 111.4
See application file for complete search history.

(56) References Cited

U.S. PATENT DOCUMENTS

| | | | |
|---|---|---|---|
| 5,639,582 | A | 6/1997 | Imai et al. |
| 5,750,304 | A | 5/1998 | Yamaguchi et al. |

FOREIGN PATENT DOCUMENTS

| | | |
|---|---|---|
| JP | 54-48245 | 4/1979 |
| JP | 57-11354 | 1/1982 |
| JP | 60-103355 | 6/1985 |
| JP | 62-151866 | 7/1987 |
| JP | 62-156668 | 7/1987 |
| JP | 2-61649 | 3/1990 |
| JP | 2-308175 | 12/1990 |
| JP | 4-163464 | 6/1992 |
| JP | 5-80581 | 4/1993 |
| JP | 5-107801 | 4/1993 |
| JP | 5-289403 | 11/1993 |
| JP | 6-289650 | 10/1994 |
| JP | 6-301235 | 10/1994 |
| JP | 7-120982 | 5/1995 |
| JP | 8-87127 | 4/1996 |
| JP | 8-272133 | 10/1996 |
| JP | 9-15900 | 1/1997 |
| JP | 9-281746 | 10/1997 |
| JP | 10-202133 | 8/1998 |
| JP | 10-202193 | 8/1998 |
| JP | 10-207115 | 8/1998 |
| JP | 10-286526 | 10/1998 |
| JP | 10-286826 | 10/1998 |
| JP | 10-293425 | 11/1998 |
| JP | 10-312082 | 11/1998 |
| JP | 11/258850 | 9/1999 |
| JP | 2000-010349 | 1/2000 |
| JP | 2000-29242 | 1/2000 |
| JP | 2000-29248 | 1/2000 |
| JP | 2000-056498 | 2/2000 |
| JP | 2000-338712 | 12/2000 |
| JP | 2001-117264 | 4/2001 |
| JP | 2001-235894 | 8/2001 |

*Primary Examiner*—Mark A. Chapman
(74) *Attorney, Agent, or Firm*—Oblon, Spivak, McClelland, Maier & Neustadt, P.C.

(57) ABSTRACT

To provide a toner for developing an electrostatic charge image, which has a good low temperature fixing property whereby it is useful for an image-forming device of a low temperature heat fixing system using a heat roll having a surface temperature of at most 150° C. and it does not fuse to a blade or a toner transport roller, and which is excellent in durability with little change in the image quality in a continuous copying operation.

A toner for developing an electrostatic charge image, having base toner particles comprising at least a binder resin and a coloring agent, wherein the base toner particles contain an oil having a surface tension of at most 30 mN/m at 25° C., and the toner has a softening point of at most 100° C.

16 Claims, No Drawings

TONER FOR DEVELOPING AN ELECTROSTATIC CHARGE IMAGE AND METHOD FOR ITS PRODUCTION

BACKGROUND OF THE INVENTION

1. Field of the Invention

The present invention relates to a toner for developing an electrostatic charge image which is useful for electrography, particularly for a printer or the like employing a developing method of a one component system. More particularly, the present invention relates to a toner for developing an electrostatic image, which has a low softening point required for a low temperature fixing property and which is substantially free from fusion to a developing blade or other components of a developing apparatus even when it is applied to a developing system where durability is required and substantially free from a change in image quality caused by such fusion.

2. Discussion of Background

Dry developing systems to be used for electrography generally include a two component developing system employing a carrier and a toner as mixed, and a one component developing system employing no carrier. Among them, the two component developing system employs a carrier such as iron powder, ferrite powder, or the like, whereby a so-called toner concentration control mechanism is required to supplement a necessary amount of the toner as the toner is consumed. Therefore, the two component developing system has had problems with respect to the large size of the apparatus and the high cost. On the other hand, the one component developing system includes a magnetic one component system and a non-magnetic one component system, and an apparatus for either system can be made to be small-sized. Accordingly, in recent years, this system has been employed in many cases including personal type and full color type copying machines and printers which have been increasingly popular.

In recent years, copying machines, printers, etc. are required to have a high performance. The performance which a toner is required to have, may, for example, be such that when an image is formed, the image density is sufficient, and the image has no defect, that it can be used constantly for a long period of time, that it will sufficiently fix to paper, and that it is free from blocking during the process for its production or during its storage for transportation, and thus covers various requirements from the process for production of the toner to the image forming. Among such requirements, there are some which tend to be opposing to each other and tend to be hardly satisfied simultaneously, like the requirement that it can be used constantly for a long period of time and that it will sufficiently fix to paper. To cope with such requirements, many proposals have been made with respect to the natures of the respective components constituting the toner, the blend formulation, the production method, the production conditions, etc.

However, depending upon various phenomena and transfer systems employed for image-forming devices, there have been cases where conventional toners can provide no adequate effects to the required performances. Especially when it is attempted to lower the energy (the temperature) of the fixing device in order to reduce the power consumption or to accomplish high speed printing, if the toner fails to melt sufficiently at the low temperature, the fixing failure will result. Accordingly, it has been common to lower the softening point or the glass transition point of the binder resin. However, in a one component developing system wherein a substantial load is exerted to a toner, such a method brings about fusion to a blade for regulating the toner layer on a developing roll during a continuous copying operation or to a toner transport roller or a fixing roller and thus has been a cause for e.g. deterioration in the uniformity in the image quality or formation of stria. Further, in the production of the toner containing a binder resin with a low softening point or glass transition point, its fusion to the production apparatus, or the like, is likely to take place, whereby there has been a problem such as a decrease in the yield of the toner as a product, or necessity of a step of cleaning the apparatus.

Such problems have been distinct particularly in copying machines or printers for high speed printing or large size printing. For example, it has been difficult to obtain a toner which can be used for an image-forming device of a low temperature heat fixing system employing a heat roll with a surface temperature of at most 150° C. and which sufficiently satisfies a performance not to fuse to a blade or a toner transport roller, and it has been unknown how to obtain such a toner.

SUMMARY OF THE INVENTION

The present invention has been made under these circumstances, and it is an object of the present invention to provide a toner which will sufficiently fix to paper even with a relatively low fixing energy (at a low temperature) and whereby a stabilized image quality can be obtained without fusion to e.g. a component of a developing device even in a continuous copying operation by a developing method of e.g. a one component system.

The present inventors have conducted an extensive study to solve such problems and as a result, have found that a toner having a sufficiently low glass transition point and softening point for low temperature fixing and containing in its base particles, an oil having a specific surface tension and a specific viscosity, can satisfy both a sufficient fixing property at a remarkably lower fixing temperature than ever and image stability in a continuous copying operation, and the present invention has been accomplished on the basis of such a discovery.

Namely, the present invention provides a toner for developing an electrostatic charge image, having base toner particles comprising at least a binder resin and a coloring agent, wherein the base toner particles contain an oil having a surface tension of at most 30 mN/m at 25° C., and the toner has a softening point of at most 100° C.

Further, the present invention provides a method for producing a toner for developing an electrostatic charge image, having base toner particles comprising at least a binder resin, a coloring agent and an oil having a surface tension of at most 30 mN/m at 25° C. and having a softening point of at most 100° C., which comprises fixing auxiliary fine particles on base toner particles.

According to the present invention, a toner for developing electrostatic charge image will be provided which has a good low temperature fixing property and which is excellent in durability without fusion to a blade or a toner transport roller, whereby there will be little change in image quality in a continuous copying operation.

DETAILED DESCRIPTION OF THE PREFERRED EMBODIMENTS

The toner for developing an electrostatic charge image of the present invention contains, in the base toner particles, at least a binder resin, a coloring agent and the oil and, if necessary, further contains a magnetic powder, wax, an electrification-controlling agent or other additives.

As the binder resin in the present invention, known various resins suitable for toners for developing electrostatic charge images may be used. For example, a styrene resin, a polyester resin, an epoxy resin, a polyurethane resin, a vinyl chloride resin, a low molecular weight polyethylene, a low molecular weight polypropylene, an ionomer resin, a silicone resin, a rosin-modified maleic resin, a phenol resin, a ketone resin, an ethylene/ethyl acrylate copolymer, a xylene resin and a polyvinylbutyral resin, may be mentioned. As a resin preferably employed in the present invention, a styrene resin or a polyester resin may be mentioned, and a polyester resin is particularly preferred.

These resins may be used not only alone but also in combination as a mixture of two or more of them. Further, the binder resin in the present invention may be used in the form of a non-crosslinked resin, a cross-linked resin or a mixture thereof, depending upon the fixing system of the image-forming device. The method for producing the binder resin may, for example, be bulk polymerization, solution polymerization, interfacial polymerization, suspension polymerization or emulsion polymerization. However, the binder resin may be used irrespective of the polymerization method.

The styrene resin may be a homopolymer or a copolymer containing styrene or a styrene-substituted material, such as a polystyrene, a chloropolystyrene, a poly-α-methyl styrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer (a styrene/methyl acrylate copolymer, a styrene/ethylene acrylate copolymer, a styrene/butyl acrylate copolymer, a styrene/octyl acrylate copolymer or a styrene/phenyl acrylate copolymer), a styrene/methacrylate copolymer (such as a styrene/methyl methacrylate copolymer, a styrene/ethyl methacrylate copolymer, a styrene/butyl methacrylate copolymer, a styrene/octyl methacrylate copolymer or a styrene/phenyl methacrylate copolymer), a styrene/methyl α-chloroacrylate copolymer, or a styrene/acrylonitrile/acrylate copolymer. Such a styrene resin may be used in the form of a cross-linked resin as copolymerized with a cross-linkable monomer as the case requires.

The polyester resin is preferably one obtained by polycondensation of a polyhydric alcohol component with a polybasic carboxylic acid component.

Among polyhydric alcohol components, a dihydric alcohol component may, for example, be a diol such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol or polytetramethylene glycol, bisphenol A, hydrogenated bisphenol A, an etherified bisphenol such as polyoxyethylene-modified bisphenol A or polyoxypropylene-modified bisphenol A, or other alcohol monomers. Among them, one containing bisphenol A may preferably be used.

Further, among polybasic carboxylic acid components, a dibasic carboxylic acid component may, for example, be maleic acid, fumaric acid, citraconic acid, itaconic acid, glutaconic acid, phthalic acid, isophthalic acid, terephthalic acid, naphthalene dicarboxylic acid, diphenic acid, cyclohexane dicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid or acid anhydrides or lower alkyl esters of such acids. Among them, one containing isophthalic acid may preferably be used.

Further, the binder resin in the present invention preferably contains a trihydric or higher hydric alcohol component and/or a tribasic or higher basic carboxylic acid component.

The trihydric or higher hydric alcohol component may, for example, be sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane or 1,3,5-trihydroxymethylbenzene.

The tribasic or higher basic carboxylic acid component may, for example, be 1,2,4-benzenetricarboxylic acid (trimellitic acid), 1,2,5-benezenetricarboxylic acid, naphthalenetricarboxylic acid, butanetricarboxylic acid, hexanetricarboxylic acid, 1,3-dicarboxyl-2-methyl-2-methylenecarboxypropane, cyclohexanetricarboxylic acid, tetra(methylenecarboxyl)methane, octanetetracarboxylic acid, pyromellitic acid, Empol trimer acid, or acid anhydrides or alkylesters of such acids.

Such a trihydric or higher hydric higher alcohol component and/or tribasic or higher basic carboxylic acid component is preferably contained in an amount of from 0.01 to 30 mol % in the total monomers constituting the polyester resin. When such a trihydric or higher hydric alcohol component and/or a tribasic or higher basic carboxylic acid component is contained, both a low temperature fixing property required for a low energy fixing and durability required for image stability in a continuous copying operation, can be satisfied, such being preferred.

Further, a monofunctional alcohol or a monofunctional carboxylic acid such as benzoic acid, salicylic acid, myristic acid, palmitic acid or stearic acid, may be incorporated.

Further, the toner for developing an antistatic charge image of the present invention preferably contains urethane bonds in the structure of the binder resin. The urethane bonds in the present invention are ones obtained by using a diisocyanate compound or the like as raw material. The isocyanate compound may, for example, be hexamethylene diisocyanate, isophorone diisocyanate, tolylene diisocyanate, diphenylmethane diioscyanate, xylylene diisocyanate, tetramethyl diioscyanate, p-phenylene diisocyanate, naphthalene diisocyanate, trimethylhexamethylene diisocyanate or lysine diisocyanate. When the diisocyanate compound is used as the raw material, it is preferably contained in an amount of from 0.01 to 30 wt % in the binder resin. When the toner has urethane bonds in the structure of the binder resin, the durability of the toner will be improved, such being preferred.

In a case where the binder resin is a polyester resin, its acid value is preferably from 2 to 50 KOHmg/g, more preferably from 3 to 30 KOHmg/g. If the acid value is less than the above range, dispersibility of the oil, the coloring agent, the electrification-controlling agent or the like may sometimes deteriorate. On the other hand, if the acid value exceeds the above range, the stability in electrification of the toner may sometimes deteriorate. Here, the acid value of the polyester resin can be calculated by the value obtained by titration with an indicator of a solution obtained by dissolving a resin sample in a solvent such as toluene.

The binder resin to be used in the present invention preferably has a softening point (hereinafter referred to as Sp) and a glass transition point (hereinafter referred to as Tg) as low as possible in order to improve the low energy fixing property of the toner.

Sp of the binder resin is usually at most 100° C., preferably at most 95° C. for low energy fixing. Further, such Sp is preferably at least 50° C. from the viewpoint of the blocking resistance. Here, Sp of the binder resin can be obtained as a temperature at a midpoint of a strand from the initiation to the end of flow, when 1.0 g of a sample is measured by a flow tester (CFT-500, manufactured by Shimazu Corporation) under conditions such that the nozzle is 1 mm×10 mm, the load is 30 kg, the preheating time is 5 minutes at 50° C. and the temperature rising speed is 3° C./min.

Further, it is preferred for low energy fixing that Tg of the binder resin is usually at most 55° C., preferably at most 53° C. Further, such Tg is preferably at least 35° C. from the viewpoint of blocking resistance. Here, for Tg of the binder resin, tangent lines may be drawn on both sides of the transition (inflection) starting portion of the curve measured by a differential scanning calorimeter (DTA-40, manufactured by Shimazu Corporation) under a condition of a temperature rising rate of 10° C./min, and Tg may be obtained as a temperature at the intersection of the two tangent lines.

Sp and Tg of the binder resin in the present invention can be adjusted to the above ranges by adjusting the types and the compositional ratio of resins, the molecular weight, etc. Otherwise, it is possible to select and use one within the above ranges among commercially available resins.

In the present invention, an oil having a surface tension of at most 30 mN/m and a viscosity of from 10 to 1,000 $mm^2/s$ at 25° C., is incorporated to the base toner particles in order not to bring about deterioration of the image quality in a continuous copying operation even when a binder resin having such low Sp and low Tg is used.

Usually, a toner employing a binder resin having low Sp and low Tg is likely to fuse to various portions in the developing tank, such as a sleeve to hold the toner, a blade to regulate the thickness of the toner layer or a charged roller to charge the toner, in a continuous copying operation, whereby formation of stria due to non-uniformity of the layer thickness or image defects such as fogging due to electrification failure, are likely to result. According to the present invention, the above mentioned oil is incorporated into the base toner particles, whereby even in a case where such a binder resin having low Sp and low Tg is used, its deposition to various portions within the developing tank can be suppressed, and consequently, it is possible to suppress formation of the above-mentioned image defects even in a continuous copying operation. Namely, by the incorporation of the oil having a low surface tension into the base toner particles, even with a binder resin which undergoes softening and melting at a low temperature, the oil tends to uniformly diffuse at the time of fixing and provide a releasing effect with a small amount.

The oil in the present invention has a surface tension of at most 30 mN/m, preferably at most 25 mN/m, more preferably at most 12 mN/m, particularly preferably at most 21 mN/m, at 20° C. If the surface tension exceeds the above range, the releasing effects at the time of fixing tend to be inadequate, such being undesirable. The surface tension should better be small to obtain the effects of the present invention. However, if it is less than 10 mN/m, fouling of the image-forming device due to bleeding out (leakage) from the toner may result to cause deterioration of the image. Here, the surface tension may be measured by suitably selecting a measuring method depending upon the viscosity characteristics and the nature of the oil, among common measuring methods such as a Wilhelmy method (plate method), a pendant drop method, a bubble pressure method and a contact angle method.

The oil to be used in the present invention is not particularly limited so long as it is one having fluidity at 25° C. However, the viscosity at 25° C. is preferably at least 10 $mm^2/s$, more preferably at least 50 $mm^2/s$, more preferably at least 70 $mm^2/s$, preferably at most 1,000 $mm^2/s$, more preferably at most 800 $mm^2/s$, more preferably at most 600 $mm^2/s$. If the viscosity is less than the above range, no adequate releasing effect will be obtained, and there may be an undesirable case such that fusion or the like will result in a continuous copying operation. If the viscosity exceeds the above range, the fluidity of the toner tends to be extremely low, whereby deterioration in solid black uniformity or decrease in the image density is likely to take place, such being undesirable. Here, the viscosity can be measured by the method for measuring the viscosity of liquid as disclosed in JIS Z8803.

The above oil preferably has a small volatile content, and the volatile content at 150° C. for 24 hours is preferably at most 2 wt %, more preferably at most 1 wt %. If the volatile content in the oil exceeds the above range, especially when the fixing temperature became high, staining of the image-forming device due to the volatile component in the oil is likely to result, which may cause deterioration of the image. Here, measurement of the volatile content at 150° C. for 24 hours is carried out by determining the change in mass of the oil between before and after leaving the oil under such conditions.

Further, the above oil is added preferably in an amount within a range of usually from 0.01 to 10 parts by weight, preferably from 0.1 to 5 parts by weight, per 100 parts by weight of the base toner particles. If the amount of the oil exceeds the above range, there may be a case where poor fluidity of the toner will cause deterioration of the image.

In the present invention, the oil is present in such a state as dispersed in the base toner particles i.e. in the binder resin. The dispersed state is not particularly limited, but it is preferred that the oil is not present as an independent phase in the base toner particles. Specifically, it is preferably dispersed to such an extent that it will not be observed as an oil phase under observation by a transmission electron microscope with about 10,000 magnifications. If the oil is present in the form of an independent phase in the base toner particles, there may be a case where staining of an image-forming device due to the bleed out (leakage) from the toner will result thereby to cause deterioration of the image.

The oil in the present invention is not limited with respect to its chemical structure so long as it is a compound having the above-mentioned surface tension and viscosity. However, it may, for example, be silicone oil, fluorinated oil, a fluoride of low molecular weight polyolefin or paraffin, or a fluoride of low molecular weight polyester or long chain ester plasticizer, and a plurality of them may be used in combination. Among them, silicone and fluorinated oil are particularly preferred.

The silicone oil is not particularly limited so long as it is a liquid oil which contains silicon atoms in the main skeleton of the molecule and which shows fluidity at 25° C., but it may, for example, be an organopolysiloxane, an organopolymetallosiloxane having an alkyl group such as a methyl group, an ethyl group, a propyl group or a butyl group or an aryl group such as a phenyl group, a phenol group, a styryl group or a benzyl group in its side chain, an organopolysilazane, an organopolysilmethylene or an organopolysilphenylene. Further, such a compound may be one having a side chain or the molecular terminal modified by e.g. an amino group, an epoxy group, a mercapto group, a carboxyl group, a hydroxyl group, an alkoxysilyl group, a carbinol group, an alkoxy group, an alkyl group, an aralkyl group or a polyether, or it may be modified by halogenation such as fluorination or chlorination. Further, it may be a block copolymer or a graft copolymer constituted by a chain containing silicon atoms in the main skeleton of the molecule and a chain containing no silicon atoms in the main skeleton of the molecule. Among them, dimethylpolysiloxane or modified dimethylpolysiloxane is preferred. Further, the silicone oil in the present invention may be one having a linear structure or one having a cyclic structure or a network structure i.e. a partially cross-linked structure.

The above mentioned fluorinated oil is a fluorocarbon or one having some of hydrogen atoms in a hydrocarbon substituted by fluorine atoms, and it may be one having a side chain or the molecular terminal modified by e.g. an amino group, an epoxy group, a mercapto group, a carboxyl group, a hydroxyl group, an alkoxysilyl group, a carbinol group, an alkoxy group, an alkyl group, an aralkyl group or a polyether, or one modified by halogenation such as fluorination or chlorination. Further, it may be a block copolymer or a graft copolymer constituted by a chain containing fluorine atoms and a chain containing no fluorine atoms. Among them, a perfluorocarbon is preferred. Here, the fluorinated oil in the present invention may be one having a linear structure, or one having a cyclic structure or a network structure i.e. a partially cross-linked structure.

Such silicone oil or fluorinated oil may be used by suitably selecting one having the above mentioned surface tension and viscosity among commercially available oils.

The coloring agent to be used in the present invention is not particularly limited so long as it is one which has been commonly used for a toner for developing an electrostatic charge image. For example, titanium oxide, zinc white, alumina white, calcium carbonate, Prussian blue, various types of carbon black, lamp black, phthalocyanine blue, aniline blue, charcoal blue, ultramarine blue, methylene blue chloride, phthalocyanine green, Hansa yellow G, rhodamine dye or pigment, chrome yellow, quinacridone, benzidine yellow, quinoline yellow, rose Bengal, Dupont oil red, triallylmethane dye, anthraquinone dye, a monoazo and disazo dyes or pigments, may be used alone or in combination as a mixture. The content of the coloring agent may be an amount sufficient to form a visible image by development of the toner for developing an electrostatic charge image thereby obtainable. For example, it is preferably from 3 to 20 parts by weight, per 100 parts by weight of the binder resin. Further, the above coloring agent is preferably one not containing volatile impurities as far as possible.

In a case where electrical conductivity is to be imparted to the toner for developing an electrostatic charge image of the present invention, a conductive carbon black or other conductive materials may be added as a component of the above coloring agent. The amount of the conductive material is preferably from 0.05 to 5 parts by weight, per 100 parts by weight of the binder resin in order not to impair the low energy fixing property of the toner, and the amount may be adjusted depending upon the desired electrical conductivity of the toner.

The present invention may be a magnetic toner wherein a known magnetic powder is used as the coloring agent. The magnetic powder to be used in the present invention is a ferromagnetic substance showing ferrimagnetism or ferromagnetism at the operation temperature of copying machines, etc. (in the vicinity of from 0° C. to 60° C.), and it may, for example, be magnetite ($Fe_3O_4$), maghematite ($\gamma$-$Fe_2O_3$), an intermediate between magnetite and maghematite, a spinel ferrite of the formula $M_xFe_{3-x}O_4$ wherein M is Mn, Fe, Co, Ni, Cu, Mg, Zn, Cd or the like, or a mixed crystal thereof, a hexagonal ferrite such as $BaO.6Fe_2O_3$ or $SrO.6Fe_2O_3$, a garnet oxide such as $Y_3Fe_5O_{12}$ or $Sm_3Fe_5O_{12}$, a rutile oxide such as $CrO_2$, or one showing ferromagnetism or ferrimagnetism at a temperature in the vicinity of from 0° C. to 60° C. among metals such as Fe, Mn, Ni, Co and Cr, and other ferromagnetic alloys. Among them, fine particles of magnetite, maghematite or an intermediate of magnetite and maghematite having an average particle size of at most 3 μm, more preferably from 0.05 to 1 μm, are preferred from the viewpoint of both the function and the price. Such fine magnetic particles may be used alone, or two or more different types may be used in combination.

In a case where the toner for developing an electrostatic charge image of the present invention is used as a magnetic one component developer employing no carrier, it is desirable that the content of the magnetic powder in the toner is usually at least 15 wt %, preferably at least 20 wt %, and usually at most 70 wt %, preferably at most 60 wt %. If the content of the magnetic powder is less than the above range, there may be a case where no adequate magnetic power required for a magnetic toner can be obtained, and if it exceeds the above range, such may be a cause for a poor fixing property.

In a case where the toner for developing an electrostatic charge image of the present invention is used as a toner for a two component developer employing a carrier, it is desirable that the content of the magnetic powder in the toner is usually at least 15 wt %, preferably at least 20 wt % and usually at most 40 wt %, preferably at most 30 wt %. If the content of the magnetic powder is less than the above range, there may be a case where no adequate magnetic power required can be obtained, and if it exceeds the above range, the magnetic power tends to be so strong that it will be a cause for deterioration of the developability.

Further, in a case where the toner for developing an electrostatic charge image of the present invention is used as a non-magnetic toner and a magnetic powder is added with a view to controlling the electrification for prevention of scattering while the characteristics of a non-magnetic toner are maintained, the content of the magnetic powder in the toner is usually from 0.5 to 10 parts by weight, preferably from 0.5 to 8 parts by weight, more preferably from 1 to 5 parts by weight. If the amount exceeds the above range, the magnetic binding force of the developing roll to the toner tends to be strong, whereby the developability may decrease.

Further, if desired, other components may be incorporated. For example, in a case where it is desired to impart an electrostatic property to the toner for developing an electrostatic charge image, known positively chargeable or negatively chargeable electrification-controlling agents may be used alone or in combination. Such electrification-controlling agents are not particularly limited. The positively chargeable electrification-controlling agents may, for example, be a nigrosine dye, a quaternary ammonium salt, a triaminotriphenylmethane compound, an imidazole compound and a polyamine resin. The negatively chargeable electrification-controlling agents may, for example, be an azo dye containing metal such as Cr, Co, Al or Fe, a metal salicylate compound, a calix[n]arene compound and a metal alkyl salicylate compound. Also in selection of an electrification-controlling agent, it is preferred to select one not containing volatile impurities as far as possible.

The amount of the electrification-controlling agent may vary depending upon the desired electrostatic charge, but it is usually from 0.05 to 10 parts by weight, preferably from 1 to 5 parts by weight, per 100 parts by weight of the binder resin. If the content of the electrification-controlling agent is less than the above range, no adequate effect for improving the electrostatic property can be expected, and if it exceeds the above range, a free electrification-controlling agent will result, whereby the electrostatic property of the toner rather tends to decrease, and such may cause fogging.

To the toner for developing an electrostatic charge image of the present invention, wax may be incorporated to improve the characteristics such as offset resistance. Such wax may, for example, be polyethylene wax, polypropylene wax, paraffin wax, carnauba wax, rice wax, sasol wax, montan type ester wax, Fischer-Tropshch wax, a higher fatty acid, a fatty acid amide or a metal soap. The content of the wax is preferably from 0.1 to 30 parts by weight, per 100 parts by weight of the binder resin, whereby it is possible to improve the offset resistance without causing a problem such as filming.

The method for producing the toner for developing an electrostatic charge image of the present invention is not particularly limited, and any production method such as a pulverization method or a polymerization method such as a suspension polymerization method or an emulsion polymerization flocculation method, may be employed. Among them, a pulverization method is preferred, since the effect of the addition of the oil of the present invention is remarkable when the toner is produced by the pulverization method.

When the toner for developing an electrostatic is charge image of the present invention is produced by the pulverization method, such a method can be carried out by a conventional method. Namely, usually, base toner particles are prepared by a method wherein firstly, the binder resin, the oil, the coloring agent, and, if necessary, other components such as the magnetic powder, the electrification-controlling agent, the wax, etc. are uniformly dispersed and mixed by a mixer, and then, the mixture is melt-kneaded by e.g. a sealed kneader or a single screw or a twin screw extruder, then cooled, roughly pulverized by e.g. a crusher or a hammer mill, finely pulverized by e.g. a jet mill or a high speed rotary mill, and classified by e.g. a wind classifier (such as an elbow jet of inertia classifying system, a microplex of centrifugal classifying system or a DS separator). Further, with respect to the method for adding the oil, other than the above-mentioned method of incorporation by dispersion before melt-kneading, the oil may be added by feeding it during the melt-kneading.

When the toner for developing an electrostatic charge image of the present invention is produced by a suspension polymerization method, such a method can be carried out in accordance with a conventional method. Namely, usually, base toner particles are prepared by suspending and dispersing the above-mentioned polymerizable monomer to constitute the binder resin, the polymerization initiator, the oil, the coloring agent and, if necessary, other components such as the magnetic powder, the electrification-controlling agent, the wax, etc. in an aqueous medium by means of a dispersing machine such as a disperser, to have a proper particle size, and then polymerizing the polymerizable monomer.

Here, the method for adding the oil may be not only the method of incorporating it together with the polymerizable monomer, etc. from the initial stage of the polymerization, but also a method of adding it during the polymerization reaction.

Further, when the toner for developing an electrostatic charge image of the present invention is produced by an emulsion polymerization flocculation method, such a method may be carried out in accordance with a conventional method. Namely, usually, base toner particles are produced by a method wherein a polymerizable monomer to constitute the above mentioned binder resin is emulsified in an aqueous medium containing a polymerization initiator, an emulsifier and the oil, the polymerizable monomer is polymerized with stirring to firstly produce a polymer primary particle emulsion, then to the obtained polymer primary particle emulsion, the coloring agent and, if necessary, other components such as the magnetic powder, the electrification-controlling agent, the wax, etc., are added to flocculate the polymer primary particles to obtain agglomerates of primary particles, and further, the primary particle agglomerates are heated and aged to obtain the base toner particles. Here, the method for adding the oil may be not only the method of preliminarily adding it together with the polymerization initiator and the emulsifier, but also a method of adding it in the flocculation step.

Further, the flocculation may be carried out by mixing polymer primary particles containing the oil and polymer primary particles containing no oil.

Still further, at the time of adding a coating resin to cover base toner particles obtained by the suspension polymerization method or the emulsion polymerization flocculation method to produce a capsule toner, the oil may be added together with such a coating resin to incorporate the oil into the toner, or the oil may be contained in the coating resin, so that the oil will be incorporated in the toner.

The particle size of the base toner particles thus obtained is preferably from 4 to 15 μm, more preferably from 5 to 9 μm. Here, the particle size may be measured by means of e.g. a multisizer (manufactured by Coulter Company).

After such a process, it is preferred to add auxiliary fine particles to the base toner particles in order to improve the fluidity, the electrification stability, or the blocking resistance at a high temperature, etc. By the addition of such auxiliary fine particles, in addition to the effects by the addition of the oil of the present invention, the effects to obtain a stabilized image in a continuous copying operation without bringing about fusion to e.g. components of the developing tank, will be further distinct even with base toner particles having low glass transition point and softening point, such being desirable.

The auxiliary fine particles to be fixed on the surface of the base toner particles may be suitably selected for use among various inorganic or organic fine particles. As the inorganic fine particles, various carbides such as silicon carbide, boron carbide, titanium carbide, zirconium carbide, hafnium carbide, vanadium carbide, tantalum carbide, niobium carbide, tungsten carbide, chromium carbide, molybdenum carbide and calcium carbide, various nitrides such as boron nitride, titanium nitride and zirconium nitride, various borides such as zirconium boride, various oxides such as titanium oxide, calcium oxide, magnesium oxide, zinc oxide, copper oxide, aluminum oxide, cerium oxide, silica and colloidal silica, various titanate compounds such as calcium titanate, magnesium titanate and strontium titanate, phosphate compounds such as calcium phosphate, sulfides such as molybdenum disulfide, fluorides such as magnesium fluoride and carbon fluoride, various metal soaps such as aluminum stearate, calcium stearate, zinc stearate and magnesium stearate, talc, bentonite, various carbon black and conductive carbon black, magnetite and ferrite, may, for example, be employed. As the organic fine particles, fine particles of a styrene resin, an acrylic resin, an epoxy resin or a melamine resin, may, for example, be employed.

Among such auxiliary fine particles, silica, titanium oxide, alumina, zinc oxide, various carbon black or conductive carbon black may, for example, be particularly preferably employed. Further, such auxiliary fine particles may be ones having the surface of the above mentioned inorganic or organic fine particles treated by surface treatment such as hydrophobic treatment by a treating agent such as a silane coupling agent, a titanate coupling agent, a silicone oil, a modified silicone oil, a silicone varnish, a fluorinated silane coupling agent, a fluorinated silicone oil or a coupling agent having amino groups or quaternary ammonium bases. Such treating agents may be used in combination as a mixture of two or more of them.

The above auxiliary fine particles have an average particle size of usually from 0.001 to 3 μm, preferably from 0.005 to 1 μm, and a plurality having different particle sizes may be used in combination. The average particle size of the auxiliary fine particles may be obtained by observation by an electron microscope.

As the above auxiliary fine particles, two or more different types may be used in combination. For example, surface-treated ones and ones not surface-treated may be used in combination, or differently surface-treated ones may be used in combination. Otherwise, positively chargeable ones and negatively chargeable ones may be suitably combined for use.

As a method for adding the auxiliary fine particles to the base toner particles, a method is known to add and blend them by means of a high speed stirring machine such as a Henschel mixer. However, in order to improve the blocking resistance at a high temperature, it is preferred to have the auxiliary fine particles fixed on the surface of the base toner particles. In the present invention, fixing means an addition method employing an apparatus capable of exerting a compression sharing stress (hereinafter referred to as a compression shearing treatment apparatus) or an apparatus capable of melting or softening the surface of the base toner particles (hereinafter referred to as a particle surface-melting treatment apparatus). By such fixing treatment, the auxiliary fine particles will firmly be fixed to the surface of the base toner particles without substantial pulverization of the base toner particles, whereby blocking resistance during the storage at a high temperature will be improved, and it is possible to produce a toner which is less likely to bring about fusion to components of a copying machine or a printer even in a continuous copying operation.

The above-mentioned compression shearing treatment apparatus is constructed to have a narrow clearance defined by a head surface and a head surface, a head surface and a wall surface, or a wall surface and a wall surface, which are mutually mobile while a distance is maintained, so that the particles to be treated are forcibly passed through the clearance, whereby a compression stress and a shearing stress will be exerted to the surface of the particles without substantially pulverizing them. As the compression shearing treatment apparatus to be used, a mechanofusion apparatus manufactured by Hosokawa Micron K.K., may, for example, be mentioned.

The above-mentioned particle surface-melting treatment apparatus is usually constructed so that a mixture of the base toner fine particles and the auxiliary fine particles is instantaneously heated to a temperature of at least the melting-initiation temperature by means of e.g. a hot air stream thereby to have the auxiliary fine particles fixed. As the particle surface-melting treatment apparatus to be used, a surfusing system manufactured by Nippon Neumatic K.K. may, for example, be mentioned.

With the toner for developing an electrostatic charge image of the present invention, coverage of the auxiliary fine particles over the base toner particles is preferably at least 80%, more preferably at least 90%, particularly preferably at least 94%, as a value calculated by the following formula (1). When the coverage is within such a range, it is possible to impart a sufficient electrostatic property and fluidity to the toner, to present a good influence against lowering of the image density, deterioration of white background fogging or non-uniformity of a solid black portion, and to obtain a stabilized image quality without bringing about fusion to e.g. components of the developing tank in a continuous copying operation, such being desirable.

The higher the coverage, the better. However, excessive auxiliary fine particles may bring about a problem such as deterioration of the fixing property, deterioration of the image quality, such as fogging or stria due to formation of a free auxiliary agent, or staining of the components of the developing tank. Accordingly, it is desired that coverage is usually at most 300%, preferably at most 250%, more preferably at most 200%. In a case where the sphericity of auxiliary fine particles is low, such auxiliary fine particles can cover the surface of the base toner particles, even if the above coverage exceeds 100%.

$$\text{Coverage}\ (\%) = \frac{\sqrt{3}}{2\pi}\sum_{n=1}^{a}\frac{Dt \times \rho t \times Wn}{Dn \times \rho n} \times 100 \qquad (1)$$

Dt: Average particle size of base toner particles (μm)

ρt: True density of base toner particles (g/cm$^3$)

Dn: Average particle size of auxiliary fine particles (μm)

ρn: True density of auxiliary fine particles (g/cm$^3$)

Wn: Parts by weight of auxiliary fine particles per 100 parts by weight of base toner particles a: Number of types of auxiliary fine particles.

Here, the true density (ρt) of the base toner particles and the true density (ρn) of the auxiliary fine particles n may be obtained, for example, by suitably selecting a common method for measuring a density such as a pressure difference system, a float-and-sink system or an immersion system.

The toner for developing an electrostatic charge image of the present invention thus obtained preferably has a particle size of from 4 to 15 μm, more preferably from 5 to 9 μm.

Sp of the toner for developing an electrostatic charge image of the present invention is at most 100° C., preferably at most 98° C., more preferably at most 95° C. When Sp of the toner is within the above range, low energy fixing will be possible, and fixing can be carried out satisfactorily even when a heat fixing roll having a surface temperature of at most 150° C., preferably at most 130° C., particularly preferably at most 110° C., is used. Further, such Sp is preferably at least 50° C. from the viewpoint of the blocking resistance.

Further, Tg of the toner for developing an electrostatic charge image of the present invention is preferably at most 55° C., more preferably at most 53° C. When Tg of the toner is within the above range, low energy fixing will be possible, and for example, fixing can be carried out satisfactorily even when a heat fixing roll having a surface temperature of at most 150° C., preferably at most 130° C., particularly preferably at most 110° C., is used. Further, such Tg is preferably at least 35° C. from the viewpoint of the blocking resistance.

Sp and Tg of the toner for developing an electrostatic image of the present invention will be substantially influenced by the type of the binder resin and the compositional ratio, and thus can be adjusted by suitably optimizing them. Further, they can be adjusted also by the molecular weight of the binder resin, the gel content and the type and amount of a low melting point component such as wax. Further, the binder resin to be used to adjust Sp and Tg of the toner for developing an electrostatic charge image of the present invention within the above ranges, may be suitably selected for use among commercially available resins.

The developing system wherein the toner for developing an electrostatic charge image of the present invention is employed, is not particularly limited, and it may be used for a magnetic two component developer wherein a magnetic powder such as ferrite or magnetite is incorporated as a carrier to transport the toner by a magnetic force to electrostatic latent image portions, or a magnetic one component developer wherein such a magnetic powder is incorporated in the toner, or a non-magnetic one component developer wherein no magnetic powder is employed for the developer. Particularly when the toner for developing an electrostatic charge image of the present invention is used as a one component developer where the durability is required for the toner, its effects will be remarkable.

Further, the magnetic powder as a carrier to be used for the magnetic two component developer, is preferably one having the surface treated with e.g. a silicone resin, an acrylic resin or a fluorinated resin.

The toner for developing an electrostatic charge image of the present invention may suitably be used in an image-forming device of heat fixing system employing a heat roll having a surface temperature of at most 150° C., preferably at most 130° C., particularly preferably at most 110° C.

As mentioned above, the toner for developing an electrostatic charge image of the present invention has a good low temperature fixing property and is free from fusion to e.g. a blade or a toner-transport roller and excellent in durability with little change in the image quality in a continuous copying operation. Further, the toner for developing an electrostatic charge image of the present invention is free from a problem such as deposition to various mixing machines during production, or fusion to the pulverizer or classifier, which is usually problematic with a toner having a low temperature fixing property, and thus is excellent also from the viewpoint of the production.

EXAMPLES

Now, the present invention will be described in further detail with reference to the Examples. However, it should be understood that the present invention is by no means restricted to such specific Examples. Here "parts" means "parts by weight" unless otherwise specified.

Example 1

A polyester resin comprising isophthalic acid, bisphenol A and trimethylolpropane as monomers and having urethane bonds formed by toluene diisocyanate, magnetite as a magnetic powder, and a dimethylpolysiloxane oil having a surface tension of 20.6 mN/m by a Wilhelmy method (plate method) and a viscosity of 500 $mm^2/s$ at 25° C., were mixed in a weight ratio of 100:95:1, then kneaded by a twin screw kneader (PCM-30, manufactured by Ikegai Tekko K.K.), pulverized by a jet mill and classified to obtain base toner particles having an average particle size of 14 μm. To 100 parts of the particles, conductive carbon black (EC600JD, manufactured by Ketjen Black Company, particle size: about 37 nm) was added in an amount of 1 part as auxiliary fine particles, and fixing treatment was carried out at 57° C. for 15 minutes by a mechanofusion system (manufactured by Hosokawa Micron K.K.) to obtain a toner for developing an electrostatic charge image. The coverage of the auxiliary fine particles was 94.8%, as calculated by the formula (1), and the toner had Sp of 90° C. and Tg of 53° C.

The obtained toner for developing an electrostatic charge image was charged into a printer of a magnetic one component electrostatic print recording system having an organic photoreceptor, and a non-fixed image was developed and fixed by means of a heat roll type fixing machine having a surface temperature of 100° C., to obtain a fixed image.

Evaluation of the image was carried out by the following methods to obtain the results shown in Table 2.

(1) Image Density

An image pattern having a solid black portion was printed, and the solid black portion was measured by a Macbeth densitometer and evaluated by the following standards.

o: at least 1.1: means that the solid portion is sufficiently black.

Δ: 0.8 to 1.1: means that the solid portion is slightly pale.

X: less than 0.8: means that the solid portion is so pale that it is not useful.

(2) Solid Uniformity

Solid black was printed over the entire area of A3 plain paper, and the uniformity of black was evaluated under the following standards.

o: good.

Δ: black as a whole although a slightly pale image density portion is observed.

X: thin spots or white portions are observed.

(3) Fixing Strength

An image pattern having a solid black portion was printed. Then, the solid black portion was rubbed with a finger, and the degree of peeling of the fixed toner was evaluated under the following standards.

o: good without peeling.

Δ: slight peeling of the toner is observed.

X: peeling of the toner is distinct.

(4) Fusion to Blade

Development of 10,000 sheets was carried out, whereby the degree of fusion of the toner to the blade for regulating the layer thickness at the developing tank portion of the printer, was visually observed and evaluated under the following standards.

o: good.

Δ: slight fusion of the toner is observed, but is not influential over the image quality.

X: fusion of the toner is observed and stria-type image defects are observed.

Example 2

A toner for developing an electrostatic charge image was prepared in the same manner as in Example 1 except that isophthalic acid as a monomer constituting the binder resin was changed to terephthalic acid. As a result, Sp and Tg of the toner became as shown in Table 1. The image density, the solid uniformity, the fixing strength and the fusion to blade, were evaluated in the same manner as in Example 1, and the results are shown in Table 2.

Example 3

A toner for developing an electrostatic charge image was prepared in the same manner as in Example 1 except that a polyester comprising terephthalic acid, trimellitic acid and bisphenol A as monomers constituting the binder resin was used, and the amount of dimethylpolysiloxane was changed to 5 parts. As a result, Sp and Tg of the toner became as shown in Table 1. The image density, the solid uniformity, the fixing strength and the fusion to blade, were evaluated in the same manner as in Example 1, and the results are shown in Table 2.

Example 4

A toner for developing an electrostatic charge image was prepared in the same manner as in Example 1 except that the amount of dimethylpolysiloxane oil was changed to 5 parts. As a result, Sp and Tg of the toner became as shown in Table 1. The image density, the solid uniformity, the fixing strength and the fusion to blade, were evaluated in the same manner as in Example 1, and the results are shown in Table 2.

Example 5

A toner for developing an electrostatic charge image was prepared in the same manner as in Example 1 except that as the oil, dimethylpolysiloxane oil having a surface tension of 20.5 mN/m by a Wilhelmy method (plate method) and a viscosity of 100 $mm^2/s$ at 25° C., was used. Sp and Tg of the toner are shown in Table 1. The image density, the solid uniformity, the fixing strength and the fusion to blade were evaluated in the same manner as in Example 1, and the results are shown in Table 2.

Example 6

A toner for developing an electrostatic charge image was prepared in the same manner as in Example 1 except that as the oil, amino-modified dimethylpolysiloxane having a surface tension of 20.4 mN/m by a Wilhelmy method (plate method) and a viscosity of 500 $mm^2/s$ at 25° C., was used. Sp and Tg of the toner are shown in Table 1. The image density, the solid uniformity, the fixing strength and the fusion to blade were evaluated in the same manner as in Example 1, and the results are shown in Table 2.

Example 7

A toner for developing an electrostatic charge image was prepared in the same manner as in Example 1 except that the amount of the auxiliary fine particles was changed to 0.8 part (coverage: 75.9%). Sp and Tg of the toner are shown in Table 1. The image density, the solid uniformity, the fixing strength and the fusion to blade, were evaluated in the same manner as in Example 1, and the results are shown in Table 2.

Comparative Example 1

A toner for developing an electrostatic charge image was prepared in the same manner as in Example 1 except that the same resin as in Example 3 was used, and no dimethylpolysiloxane oil was added. As a result, Sp and Tg of the toner became as shown in Table 1.

The image density, the solid uniformity, the fixing strength and the fusion to blade were evaluated in the same manner as in Example 1, and the results are shown in Table 2. In the black solid print portion, a thin portion was observed, and after developing 10,000 sheets, fusion of the toner and stria-type image defects were observed.

Comparative Example 2

A toner for developing an electrostatic charge image was prepared in the same manner as in Example 1 except that instead of dimethylpolysiloxane oil, 3 parts of polypropylene wax having a melting point of 100° C. and a surface tension of 32.7 mN/m by a contact angle method (by Zisman-plot) was added. As a result, Sp and Tg of the toner became as shown in Table 1. The image density, the solid uniformity, the fixing strength and the fusion to blade, were evaluated in the same manner as in Example 1, and the results are shown in Table 2. In the black solid print portion, slight peeling of the toner was observed, and after developing 10,000 sheets, fusion of the toner and stria-type image defects were observed. Further, the polypropylene wax used had no fluidity at 25° C.

Comparative Examples 3 and 4

A toner for developing an electrostatic charge image was prepared in the same manner as in Example 1 except that the monomers constituting the binder resin were as shown in Table 1. As a result, Sp and Tg of the toner became as shown in Table 1. The image density, the solid uniformity, the fixing strength and the fusion to blade, were evaluated in the same manner as in Example 1, and the results are shown in Table 2. In the black solid print portion, peeling of the toner was distinct.

Example 8

A toner for developing an electrostatic charge image was prepared in the same manner as in Example 1 except that base toner particles were prepared without using magnetite as the magnetic powder, and as auxiliary fine particles, instead of conductive carbon black, 0.5 part of silica R974 manufactured by Nippon Aerosil K.K. and 1.0 part of silica NAX50 manufactured by Nippon Aerosil K.K. were used. The coverage of the auxiliary fine particles was 241%, as calculated by the formula (1), and toner had Sp of 90° C. and Tg of 53° C.

The obtained toner for developing an electrostatic charge image was charged into a printer of non-magnetic one component electrostatic print recording system having a rubber sleeve/stainless (SUS) blade/organic photoreceptor, and a non-fixed image was developed. The obtained non-fixed image was fixed by means of a heat roll type fixing machine having a roller diameter of 30 mm. The surface temperature of the roller was set at every 10° C. within a range of from 100 to 160° C., whereby the lowest roller surface temperature at which the toner after fixing would not be peeled by rubbing with a finger (hereinafter referred to as the lowest fixing temperature) was examined and was found to be 130° C., which was good.

Comparative Example 5

A toner for developing an electrostatic charge image was prepared in the same manner as in Example 8 except that no dimethylpolysiloxane was used, but adhesion to the pulverizer was remarkable, and it was impossible to obtain a toner for developing an electrostatic charge image.

Comparative Example 6

A toner for developing an electrostatic charge image was prepared in the same manner as in Example 8 except that as the binder resin, a styrene/butyl acrylate copolymer was used. The coverage of the auxiliary fine particles was 241%, as calculated by the formula (1), and the toner had Sp of 137° C. and Tg of 60° C. The lowest fixing temperature of the toner was examined in the same manner as in Example 8 and found to be 150° C., thus showing that it was inferior in the low temperature fixing property as compared with Example 8.

TABLE 1

| | Monomers constituting binder resin | | | |
|---|---|---|---|---|
| | Polybasic carboxylic acid | Polyhydric alcohol | Urethane bond-forming component | Magnetic Powder |
| Ex. 1 | Isophthalic acid | Bisphenol A<br>Trimethylolpropane | Toluene diisocyanate | Magnetite |
| Ex. 2 | Telephthalic acid | Bisphenol A<br>Trimethylolpropane | Toluene diisocyanate | Magnetite |
| Ex. 3 | Telephthalic acid<br>Trimellitic acid | Bisphenol A | Nil | Magnetite |
| Ex. 4 | Isophthalic acid | Bisphenol A<br>Trimethylolpropane | Toluene diisocyanate | Magnetite |
| Ex. 5 | Isophthalic acid | Bisphenol A<br>Trimethylolpropane | Toluene diisocyanate | Magnetite |
| Ex. 6 | Isophthalic acid | Bisphenol A<br>Trimethylolpropane | Toluene diisocyanate | Magnetite |
| Ex. 7 | Isophthalic acid | Bisphenol A<br>Trimethylolpropane | Toluene diisocyanate | Magnetite |
| Ex. 8 | Isophthalic acid | Bisphenol A<br>Trimethylolpropane | Toluene diisocyanate | Nil |
| Comp. Ex. 1 | Telephthalic acid<br>Trimellitic acid | Bisphenol A | Nil | Magnetite |
| Comp. Ex. 2 | Isophthalic acid | Bisphenol A<br>Trimethylolpropane | Toluene diisocyanate | Magnetite |
| Comp. Ex. 3 | Telephthalic acid<br>Trimellitic acid | Bisphenol A | Nil | Magnetite |
| Comp. Ex. 4 | Isophthalic acid | Bisphenol A<br>Trimethylolpropane | Toluene diisocyanate | Magnetite |
| Comp. Ex. 5 | Isophthalic acid | Bisphenol A<br>Trimethylolpropane | Toluene diisocyanate | Nil |
| Comp. Ex. 6 | | Styrene/butyl acrylate | | Nil |

| | Oil | | | | | | Coverage of | Sp of | Tg of |
|---|---|---|---|---|---|---|---|---|---|
| | | Amount (parts) | Surface tension (mN/m) | Viscosity ($mm^2/s$) | Auxiliary agent | Auxiliary agent (%) | toner (° C.) | toner (° C.) |
| Ex. 1 | Dimethyl-polysiloxane | 1 | 20.6 | 500 | Conductive carbon | 94.8 | 90 | 53 |
| Ex. 2 | Dimethyl-polysiloxane | 1 | 20.6 | 500 | Conductive carbon | 94.8 | 92 | 53 |
| Ex. 3 | Dimethyl-polysiloxane | 5 | 20.6 | 500 | Conductive carbon | 94.8 | 93 | 53 |
| Ex. 4 | Dimethyl-polysiloxane | 5 | 20.6 | 500 | Conductive carbon | 94.8 | 90 | 53 |
| Ex. 5 | Dimethyl-polysiloxane | 1 | 20.5 | 100 | Conductive carbon | 94.8 | 91 | 53 |
| Ex. 6 | Amino-modified dimethyl-polysiloxane | 1 | 20.4 | 500 | Conductive carbon | 94.8 | 91 | 53 |
| Ex. 7 | Dimethyl-polysiloxane | 1 | 20.6 | 500 | Conductive carbon | 75.9 | 90 | 53 |
| Ex. 8 | Dimethyl-polysiloxane | 1 | 20.6 | 500 | Silica | 241 | 90 | 53 |
| Comp. Ex. 1 | Nil | Nil | — | — | Conductive carbon | 94.8 | 92 | 53 |
| Comp. Ex. 2 | Polypropylene wax having a melting point of 100° C. | 3 | 32.7 | No fluidity | Conductive carbon | 94.8 | 92 | 53 |
| Comp. Ex. 3 | Dimethyl-polysiloxane | 1 | 20.6 | 500 | Conductive carbon | 94.8 | 105 | 60 |
| Comp. Ex. 4 | Dimethyl-polysiloxane | 1 | 20.6 | 500 | Conductive carbon | 94.8 | 106 | 61 |
| Comp. Ex. 5 | Nil | Nil | — | — | Impossible to produce a toner | | | |
| Comp. Ex. 6 | Dimethyl-polysiloxane | 1 | 20.6 | 500 | Silica | 241 | 137 | 60 |

TABLE 2

| | Image density | Solid uniformity | Fixing strength | Fusion to blade | |
|---|---|---|---|---|---|
| | | | | After developing first sheet | After developing 10,000 sheets |
| Ex. 1 | ○ | ○ | ○ | ○ | ○ |
| Ex. 2 | ○ | ○ | ○ | ○ | ○ |
| Ex. 3 | ○ | ○ | ○ | ○ | ○ |
| Ex. 4 | ○ | ○ | ○ | ○ | ○ |
| Ex. 5 | ○ | ○ | ○ | ○ | ○ |
| Ex. 6 | ○ | ○ | ○ | ○ | ○ |
| Ex. 7 | ○ | ○ | ○ | ○ | Δ |
| Comp. Ex. 1 | ○ | Δ | ○ | ○ | X |
| Comp. Ex. 2 | ○ | ○ | Δ | ○ | X |
| Comp. Ex. 3 | ○ | ○ | X | ○ | ○ |
| Comp. Ex. 4 | ○ | ○ | X | ○ | ○ |

INDUSTRIAL APPLICABILITY

The toner of the present invention is useful as a toner for developing an electrostatic charge image which is applicable to copying machines or printers for high speed printing or large size printing.

The entire disclosure of Japanese Patent Application No. 2003-063899 filed on Mar. 10, 2003 including specification, claims and summary is incorporated herein by reference in its entirety.

What is claimed is:

1. A toner for developing an electrostatic charge image, having base toner particles comprising at least a binder resin, a coloring agent and an oil having a surface tension of at most 30 mN/m at 25° C., and base toner particles having fine auxiliary particles fixed thereto providing a coverage of at least 80% to at most 300%, and the base toner particles having a softening point of at most 100° C.

2. The toner according to claim 1, wherein the base toner particles have a particle size ranging from 4 to 15 μm.

3. The toner according to claim 1, wherein the fine auxiliary particles have an average particle size ranging from 0.001 to 3 μm.

4. The toner according to claim 3, wherein the average particle size of the fine auxiliary particles ranges from 0.005 to 1 μm.

5. The toner according to claim 1, wherein the fine auxiliary particles are selected from the group consisting of silica particles, titanium oxide particles, alumina particles, zinc oxide particles and various carbon black particles.

6. The toner according to claim 1, wherein the coverage of auxiliary fine particles is calculated by the following formula (1):

$$\text{Coverage (\%)} = \frac{\sqrt{3}}{2\pi}\sum_{n=1}^{a}\frac{Dt\times\rho t\times Wn}{Dn\times\rho n}\times 100 \quad (1)$$

Dt: Average particle size of base toner particles (μm)

pt: True density of base toner particles (g/cm$^3$)

Dn: Average particle size of auxiliary fine particles (μm)

pn: True density of auxiliary fine particles (g/cm$^3$)

Wn: Parts by weight of auxiliary fine particles per 100 parts by weight of base toner particles a: Number of types of auxiliary fine particles.

7. The toner according to claim 1, wherein the oil has a viscosity of from 10 to 1,000 mm$^2$/s at 25° C.

8. The toner according to claim 1, wherein the oil is silicone oil.

9. The toner according to claim 1, wherein the oil is present in an amount ranging from 0.01 to 10 parts by weight per part by weight of the base toner particles.

10. The toner according to claim 1, wherein the toner has a glass transition point of at most 55° C.

11. The toner according to claim 1, wherein the binder resin contains urethane bonds.

12. A method of developing an electrostatic charge image, comprising: developing an electrostatic charge image with a developer of a one component developer system containing the toner particles of claim 1.

13. An image forming device which contains the toner of claim 1 and which comprises a heat roll having a surface temperature of at most 150° C.

14. A method, comprising: preparing base toner particles comprising at least a binder resin, a coloring agent and an oil having a surface tension of at most 30 mN/m at 25° C. and having a softening point of at most 100° C.; and covering the base toner particles with fine auxiliary particles, thereby providing a coverage of at least 80% to at most 300%.

15. The toner according to claim 1, which further comprises a magnetic powder component in an amount of at least 15wt %.

16. The toner according to claim 1, wherein the fine auxiliary particles provide a coverage of at least 90% to at most 250%.

* * * * *

UNITED STATES PATENT AND TRADEMARK OFFICE

CERTIFICATE OF CORRECTION

PATENT NO. : 7,244,537 B2
APPLICATION NO. : 11/221758
DATED : July 17, 2007
INVENTOR(S) : Ohwada It is certified that error appears in the above-identified patent and that said Letters Patent is hereby corrected as shown below:

On the title page, Item (30), the Foreign Application Priority Data is incorrect. Item (30) should read:

--(30) Foreign Application Priority Data

Mar. 10, 2003 (JP).....2003-063899--

Signed and Sealed this

Twenty-first Day of August, 2007

JON W. DUDAS

*Director of the United States Patent and Trademark Office*